US011433267B1

(12) United States Patent
Leech et al.

(10) Patent No.: US 11,433,267 B1
(45) Date of Patent: Sep. 6, 2022

(54) COMPOSITIONS AND METHODS FOR DETOXIFYING CHEMICAL WARFARE AGENTS

(71) Applicant: FLIR Detection, Inc., Stillwater, OK (US)

(72) Inventors: Anna M. Leech, Pittsburgh, PA (US); Jeremy P. Walker, Oakmont, PA (US); Jennifer L. Poole, Delmont, PA (US); Robert J. Sovesky, Butler, PA (US)

(73) Assignee: TELEDYNE FLIR DETECTION, INC., Stillwater, OK (US)

( * ) Notice: Subject to any disclaimer, the term of this patent is extended or adjusted under 35 U.S.C. 154(b) by 326 days.

(21) Appl. No.: 16/579,479

(22) Filed: Sep. 23, 2019

Related U.S. Application Data

(60) Provisional application No. 62/738,302, filed on Sep. 28, 2018.

(51) Int. Cl.
*A62D 3/30* (2007.01)
*A62D 101/02* (2007.01)

(52) U.S. Cl.
CPC ..... *A62D 3/30* (2013.01); *A62D 2101/02* (2013.01)

(58) Field of Classification Search
CPC ..... A62D 3/30; A62D 3/21–1/02; A62D 2101/02
USPC ..... 588/313
See application file for complete search history.

(56) References Cited

U.S. PATENT DOCUMENTS 7,598,199 B2 10/2009 Hatton et al.
7,678,736 B1 * 3/2010 Wagner ..... B01J 20/28069 502/526
2009/0216060 A1 * 8/2009 Monzyk ..... A62D 3/38 252/182.12

OTHER PUBLICATIONS

Gershonov et al., "Facile Hydrolysis-Based Chemical Destruction of the Warfare Agents VX, GB, and HD by Alumina-Supported Fluoride Reagents", Journal of Organic Chemistry vol. 74, 2009, pp. 329-338.
Mitchell et al., "Room Temperature Reaction of Ozone and Dimethyl Methylphosphonate (DMMP) on Alumina-Supported Iron Oxide", Journal of Physical Chemistry C vol. 111, Jun. 13, 2007, United States, pp. 9417-9426.
Saxena et al., "Al2O3 Nanoparticles with and without Polyoxometalates as Reactive Sorbents for the Removal of Sulphur Mustard", Microporous and Mesoporous Materials vol. 115, 2008, Netherlands, pp. 364-375.
Saxena et al., "Kinetics of Adsorption of Sulfur Mustard on Al2O3 Nanoparticles with and without Impregnants", Journal of Chemical Technology and Biotechnology vol. 84, 2009, pp. 1860-1872.
Wagner et al., "Reactions of VX, GB, GD, and HD with Nanosize Al2O3. Formation of Aluminophosphonates", Journal of the American Chemical Society vol. 123, Feb. 2, 2001, United States, pp. 1636-1644.
Winter et al., "Defining Reactivity of Solid Sorbents: What is the Most Appropriate Metric?", Chemistry of Materials vol. 21, 2009, United States, pp. 2367-2374.
Zafrani et al., "The Reactivity of Quaternary Ammonium—versus Potassium-Fluorides Supported on Metal Oxides: Paving the Way to an Instantaneous Detoxification of Chemical Warfare Agents", Organic & Biomolecular Chemistry vol. 9, 2011, United Kingdom, pp. 8445-5451.

* cited by examiner

*Primary Examiner* — Edward M Johnson
(74) *Attorney, Agent, or Firm* — Haynes and Boone, LLP

(57) ABSTRACT

Doped metal oxide compositions are provided that consist essentially of: fluoride; alumina; and less than 10% $H_2O$. Detoxification reactions are provided that can include a mixture of less than 50% by weight doped metal oxide composition and chemical warfare agent. Cartridges are provided that can include a doped metal oxide composition, the composition including: fluoride and alumina. Methods for detoxifying a chemical warfare agent are also provided. The methods can include exposing the chemical warfare agent to a doped metal oxide composition, wherein the doped metal oxide composition is less than 50% by mass of the chemical warfare agent.

28 Claims, 14 Drawing Sheets

TBP integrations were normalized and percent decompositions were calculated by taking the ration of VX integrals.

The average integrated areas of TBP was used to normalized VX signals and stock WX was set to 100% VX.

COMPOSITIONS AND METHODS FOR DETOXIFYING CHEMICAL WARFARE AGENTS

CROSS REFERENCE TO RELATED APPLICATION

This application claims priority to and the benefit of U.S. Provisional Patent Application Ser. No. 62/738,302 filed Sep. 28, 2018, entitled "Compositions and Methods for Detoxifying Chemical Warfare Agents", the entirety of which is incorporated by reference herein.

STATEMENT AS TO RIGHTS TO INVENTIONS MADE UNDER FEDERALLY-SPONSORED RESEARCH AND DEVELOPMENT

This invention was made with Government support under Contract HR0011-14-C-0030 awarded by the Defense Advanced Research Projects Agency (DARPA). The Government has certain rights in the invention.

TECHNICAL FIELD

The present disclosure relates to the handling of chemical warfare agents and more particularly, the present disclosure is directed to compositions and methods for detoxifying chemical warfare agents.

BACKGROUND

Destruction of bulk quantities of chemical warfare agents (CWAs) such as organophosphorous nerve agents including, but not limited to, G- and V-series nerve agents, and HD sulfur mustard is an urgent concern. Stockpiles of CWAs may be encountered by warfighters and civilians and poses a serious threat to individuals and the environment. CWAs are often found in containers of varying form, function and size, and typically under hostile environments.

Metal materials have been used to hydrolyze chemical warfare agents. However, these metal catalysts have been used in bulk amounts greater than 50% by weight levels when being exposed to chemical warfare agents so the use of these metals for bulk detoxification has not been feasible in the field when warfighters encounter chemical warfare agent stockpiles.

The present disclosure provides the capability to destroy quantities of CWAs, and in accordance with example implementations, a hydrolytic, doped-metal oxide catalyst that can be used either as a tactical additive to destroy bulk CWAs in-place in permissive and non-permissive environments, or as a modular cartridge format to destroy munitions or bulk storage containers of nerve and mustard CWAs in a flow-through approach. In accordance with example embodiments, the compositions and/or methods of the present disclosure may be scalable from a small, single munition to bulk barrel to fit the tactical mission but may further be scalable as an external recirculation platform to destroy very large CWA stockpiles in-place by adapting the cartridges to a pump and external cartridge manifold.

The present disclosure provides compositions and methods for detoxifying chemical warfare agents that may be used in the field by the warfighter.

SUMMARY OF THE DISCLOSURE

Doped metal oxide compositions are provided that consist essentially of: fluoride; alumina; and less than 10% $H_2O$.

Detoxification reactions are provided that can include a mixture of less than 50% by weight doped metal oxide composition and chemical warfare agent.

Cartridges are provided that can include a doped metal oxide composition, the composition including: fluoride and alumina.

Methods for detoxifying a chemical warfare agent are also provided. The methods can include exposing the chemical warfare agent to a doped metal oxide composition, wherein the doped metal oxide composition is less than 50% by mass of the chemical warfare agent.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

The present disclosure provides compositions and methods that can take the form of a cartridge that may be part of a kit that includes doped metal oxide nanoparticles; the metal oxide can include potassium fluoride (KF)-doped aluminum oxide ($Al_2O_3$) nanoparticles ($KF/Al_2O_3$). The doped nanoparticles may act as a 'super-base' to perform heterogeneous catalytic detoxification of G- & V-series nerve agents, and HD sulfur mustard. Unlike prior use of metal oxides, the present compositions and methods can utilize the chemical agent as the bulk of the reactor (at 90 weight percent, for example), while maintaining metal oxides at or below 10 weight percent.

In accordance with example implementations, the compositions and methods of the present disclosure can include one or more of the following features: (1) Provide doped metal oxides impregnated with potassium fluoride at a sufficient percentage to perform kinetic decomposition of CWA and their simulants; (2) Provide kinetic destruction of CWA and their simulants when added at 10 wt % or less.

Example CWA's and simulants that are amenable to detoxification using the compositions and methods of the present disclosure can include, but are not limited to: i. VX (simulant DiethylVX (DEVX), V-series); ii. and iii. Sarin (GB) (simulant Diisopropylfluorophosphate (DFP), G-series); (simulant Dimethyl methylphosphonate (DMMP), G-series); and/or iv. Sulfur Mustard (simulant 2-Chloroethyl ethyl sulfide (2-CEES), HD)

Current catalysts struggle in bulk chemical settings due to harsh conditions of the products, including strong acids or thiols, which can severely degrade catalytic performance.

Figure 1:
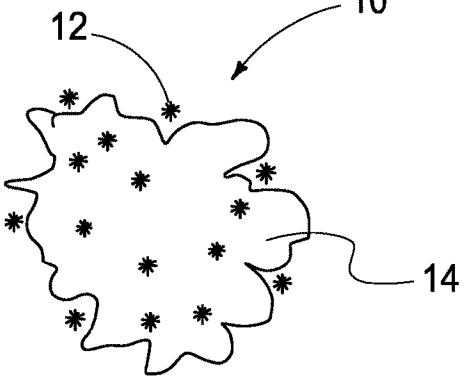
FIG. 1 is a depiction of doped metal oxide composition according to an embodiment of the disclosure.
Figure 2A:
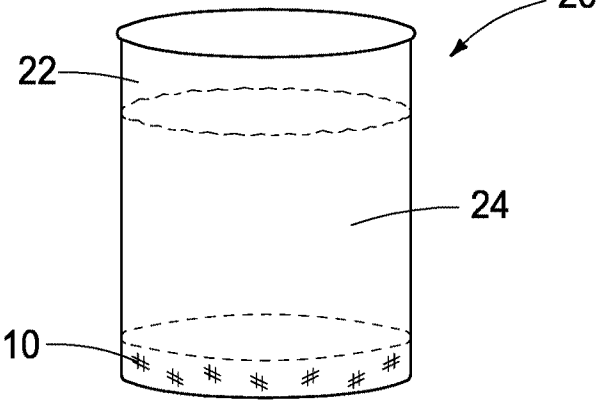

With reference to FIG. 1, the present disclosure provides a doped metal oxide composition 10 that can comprise dopant 12 such as fluoride and metal oxide 14 such as alumina. As can be seen in FIG. 1, the composition can take the form of a particle. The metal oxide of the composition can have a high degree of porosity increasing the surface to area ratio of the metal oxide and allowing for a high concentration of dopant, in some cases in excess of 40% wt dopant. In accordance with example implementations, the doped metal oxide composition can consist essentially of: fluoride; alumina; and less than 10% $H_2O$. The composition can include greater than 40% by weight fluoride. The composition can include from 20 to 80% by weight fluoride. The fluoride can be comprised by potassium fluoride. The alumina can be comprised by aluminum oxide.

In accordance with example implementations, the compositions can be prepared by calcining the metal oxide. For example, using a precision scale, weigh out 375 grams of alumina in to high form crucibles. Place the crucibles containing the alumina in a chamber furnace; turn the furnace on and ramp the chamber temperature to 800° C. at a rate of 5° C./minute. An example chamber furnace can include Carbolite CWF-1100, Model CWF 11/23. Allow the temperature to dwell at 800° C. for 24 hours. After 24 hours, allow the furnace to cool to ambient temperatures; remove alumina and place in desiccator cabinet (desiccator cabinet set to 17% RH with Nitrogen, for example, TDI International #486D), to protect from ambient humidity. Alumina sources can include but are not limited to: alumina, gamma—American Elements; alumina, transitional—Panadye; alumina—Aldrich; alumina super 1—Aldrich; alumina, basic—Aldrich; alumina, neutral—Aldrich; alumina, acidic—Aldrich; alumina, nano—Aldrich; alumina—Nanophase; alumina, nano-arc—Alfa Aesar; alumina, gamma-phase—Alfa Aesar; alumina, alpha-phase—Alfa Aesar; alumina, nanotek—Alfa Aesar.

The dopant can also be prepared in accordance with example implementations. For example, a fluoride solution can be prepared by adding 1.406 L de-ionized water to a 2 L beaker, add a stir bar and place on a magnetic stir plate. Turn the stir plate on to provide adequate mixing and add fluoride to 250 g fluoride. Once dissolved, transfer the fluoride solution to a 4 L evaporating flask (for example, Buchi 4 L evaporating flask #047990). Fluoride sources can include but are not limited to: tetra-n-butylammonium fluoride; potassium fluoride; silver fluoride; and/or sodium fluoride.

Doping the metal oxides can include, for example, slowly adding 375 g calcinated alumina, to the 4 L evaporating flask containing the fluoride solution; swirl the flask after each 75 g addition of alumina to ensure an even mixture. This mixture will be a slurry. Once all the alumina has been incorporated into the fluoride mixture, place the evaporating flask onto the rotary evaporator. The rotary evaporator should be set to NO VACUUM. Lower the evaporating flask into the water bath, before starting the rotary evaporator, turn the rotary evaporator on and allow to incorporate for 24 hours.

Water can be removed from the doped composition by turning off the rotary evaporator, raising the evaporating flask from the water bath and adjusting the parameters to initiate the removal of water. The removal of water can take approximately 8 to 9 hours. The volume of water that is collected in the collection flask should be monitored to determine when the evaporation is complete. An example model rotary evaporator used can include Buchi, Model R-300, Interface I-300, Recirculating Chiller F-305, Vacuum Pump V-300, Heating Bath B-300 Bath.

After water removal, doped metal oxides are dried in the chamber furnace for 24 hours at 160° C. Remove the metal oxide powder from the 4 L evaporating flask and record the weight of the powder that is removed. Recovery is typically 90%+/−5% (562.5 g+/−31.25 g). The doped metal oxides should be aliquoted in high form crucibles and placed in a chamber furnace. The chamber furnace temperature should be ramped from ambient to 160° C. at a rate of 5° C./minute. Once the temperature is met, dwell at 160° C. for 24 hours. After 24 hours, allow furnace to cool to ambient temperatures before removing metal oxides. The doped metal oxides should be removed and stored in desiccator cabinet to limit exposure to oxygen and ambient humidity.

With reference to FIGS. 2-7, multiple examples of methods are shown for detoxifying CWA's. Referring to FIGS. 2A and 2B, a detoxification reaction 20 is shown that includes vessel having a mixture 22 of less than 50% by weight doped metal oxide composition 10 and chemical warfare agent 24. The weight percent of doped metal oxide in the reaction mixture can range between 50% and 10%. In accordance with example implementations, the weight percent can be as low as 10%. The chemical warfare agent 24 can include G series nerve agents, V series nerve agents, and/or HD sulfur mustard agents.

In accordance with example implementations and as referenced above, the present compositions may act as a 'super base' for the destruction of organophosphorous nerve agents and mustard agents, circumventing much of the product inhibition challenge. While the compositions have been demonstrated to destroy chemical agents such as organophosphorus nerve agents and mustard agents, they can also be utilized to destroy chemical agent precursors. Chemical agents in stockpiles are frequently stored as binary components which are significantly less toxic to handle compared with the actual agent. When combined, they are mixed to form the agent. This is common in many types of munitions. One example is for sarin gas, which has a precursor, methylphosphonyl difluoride (DF), that can also be readily reacted with the doped metal oxides in order to render the DF precursor unable to be converted to sarin (GB) when combined with another binary precursor material. This is just one example that is representative of many known in the literature whereby chemical agent compounds can be stored as binary precursor components.

In accordance with example implementations, a cartridge 28 is provided that can include doped metal oxide composition 10. Cartridge 28 can include a main housing 29 and operable inlet 50 and exit ports 51. Accordingly, the cartridge can be configured as a flow through cartridge. In accordance with other implementations and in reference to FIG. 2B, cartridge 28 can include a main housing and an operable releasable seal 27. Releasable seal 27 can be configured as a cap that can be removed to allow for the discharge of the doped metal oxide composition. In accordance with other implementations the releasable seal and/or the main housing can be configured to decompose in the presence of chemical warfare agent.

Figure 3:
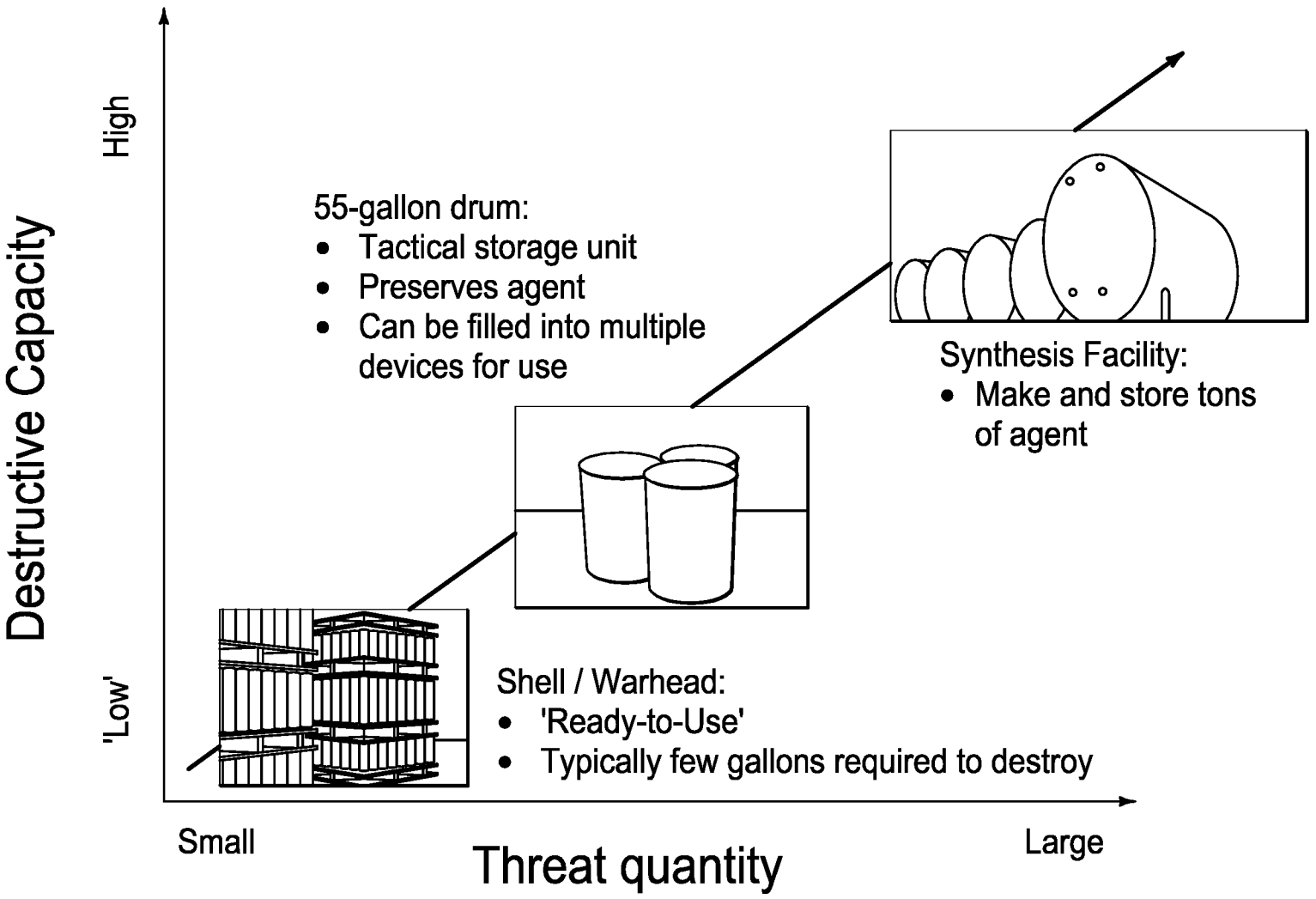
FIG. 3 is a graphical depiction of destructive capacity v. threat quantity.
Figure 4C:
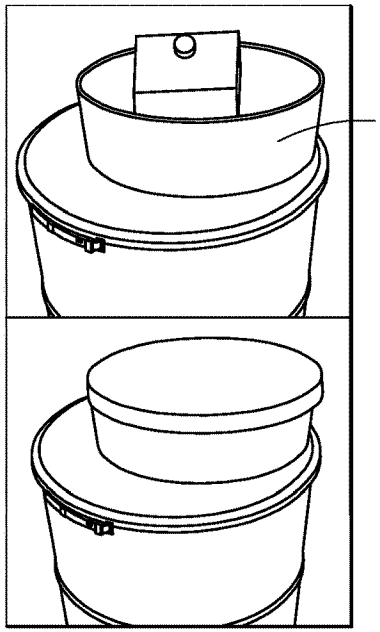
FIGS. 4A-4C depict another method for detoxifying a chemical warfare agent according to embodiments of the disclosure.
Figure 4B:
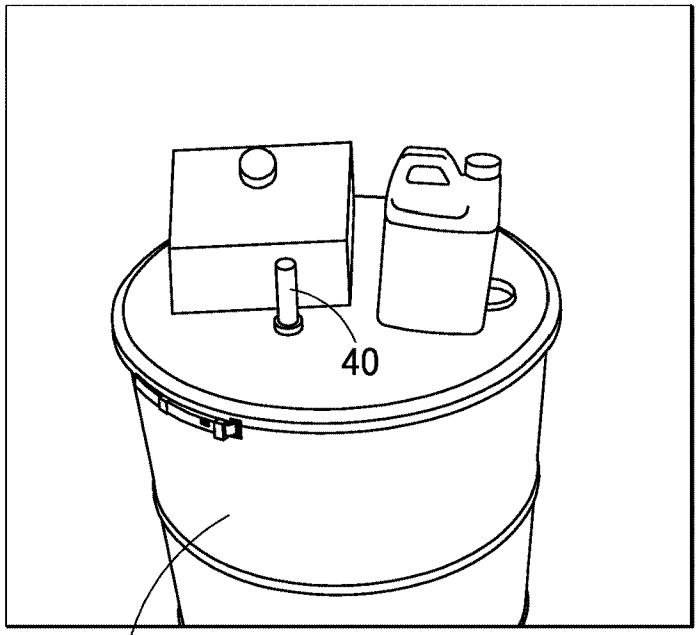
Figure 4A:
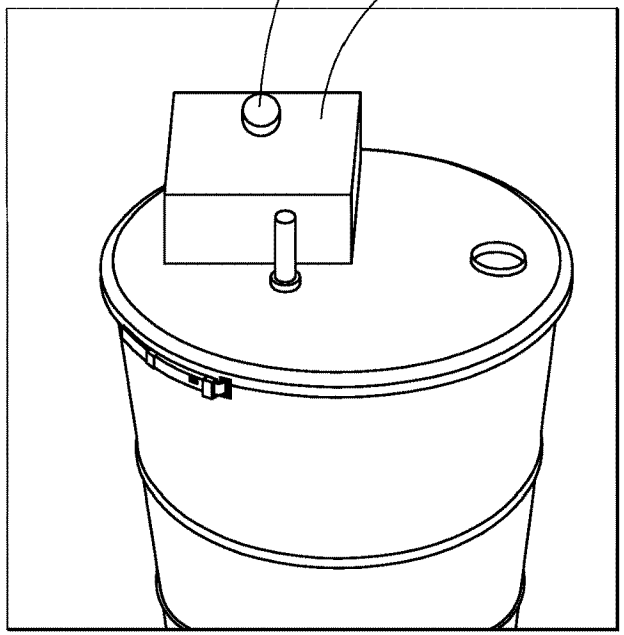

Cartridge-based methods for catalytic reactions have demonstrated increased efficiency and catalytic rate over their bulk dispersion counterparts. In addition, there are significant logistical gains in the transportation, operation, scaling, and waste disposal of such a modular design. The catalytic system, which is easily scalable, can provide improved capability over existing chemical destruction methods by providing a single solution to address the destruction of CWAs of varied size and container type in tactical environments. The potential application space is illustrated in FIG. 3.

The compositions and methods of the present disclosure can provide at least two types of capabilities. In the first, additive kits including the doped metal oxide composition in a housing that can be added to a single container as shown (FIGS. 4A-4C) can be provided. Combined with an access 40 and recirculation device 42, the metal oxide powder can destroy the agent within the container on-site.

Figure 2B:
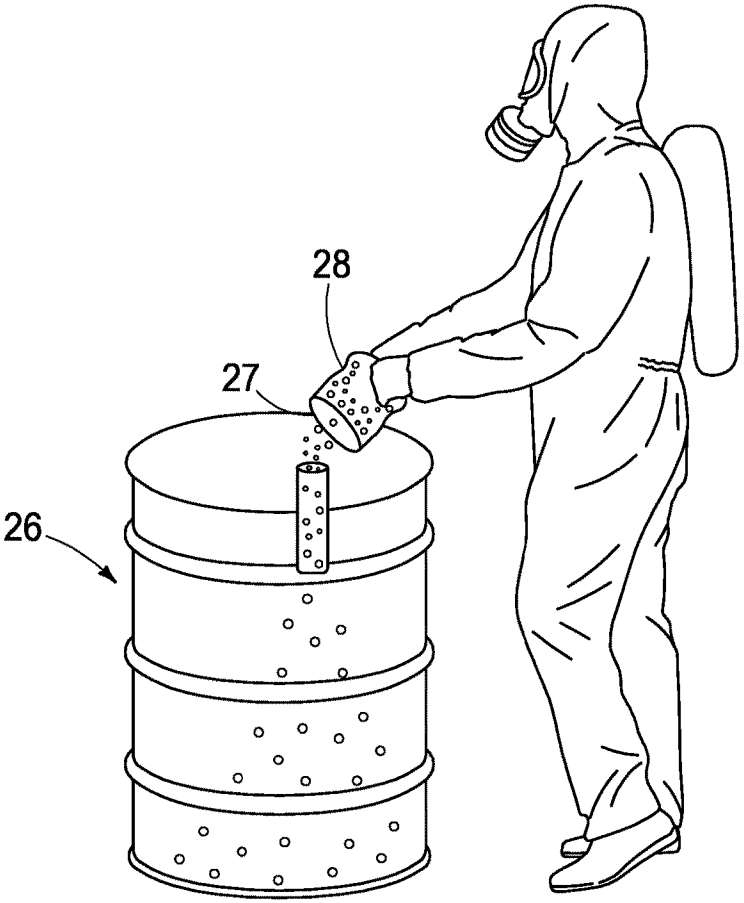
FIGS. 2A-2B depict a detoxification reaction as well as a method for detoxifying a chemical warfare agent according to embodiments of the disclosure.

With the second approach, a modular cartridge-based system 55 can be provided. Methods for detoxifying chemical warfare agents are provided using these cartridges. For example, the methods can include exposing the chemical warfare agent to a doped metal oxide composition, wherein the doped metal oxide composition is less than 50% by mass of the chemical warfare agent. This can be performed using the modular or kit-based systems. For example, the exposing can include adding the doped metal oxide composition to a vessel containing the chemical warfare agent as depicted in FIG. 2B. This method can include dispensing the doped metal oxide composition from a container such as a cartridge into the vessel.

In accordance with other implementations, the exposing can include providing the chemical warfare agent through at least one housing 29 containing doped metal oxide composition 10. The housing can be configured as a cartridge. The mass of chemical warfare agent provided through the housing can be greater than 50% of the mass of the doped metal oxide composition within the one housing and/or as high as 90%.

Figure 5B:
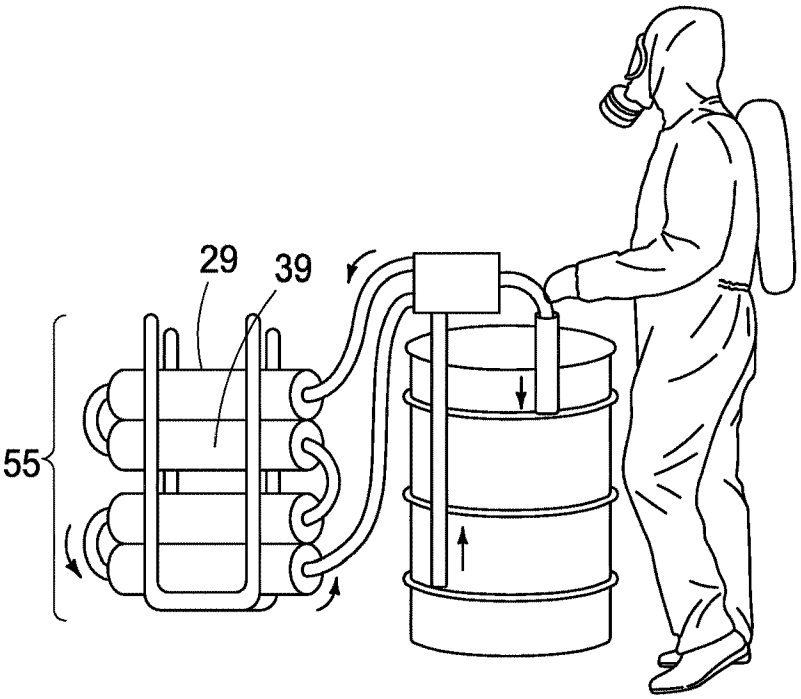
FIGS. 5A-5B depict other methods for detoxifying a chemical warfare agent according to embodiments of the disclosure.

The method can also include, providing another housing 39 containing the doped metal oxide composition. The exposing can include providing the chemical warfare agent through both housings containing the doped metal oxide composition. As shown in FIG. 5B, there can be multiple cartridges to handle as much CWA as desirable; as shown as many as 4 cartridges can be utilized to handle even more amounts of CWAs, but more or less can also be provided. The housings can be aligned in series or in parallel.

Figure 5A:
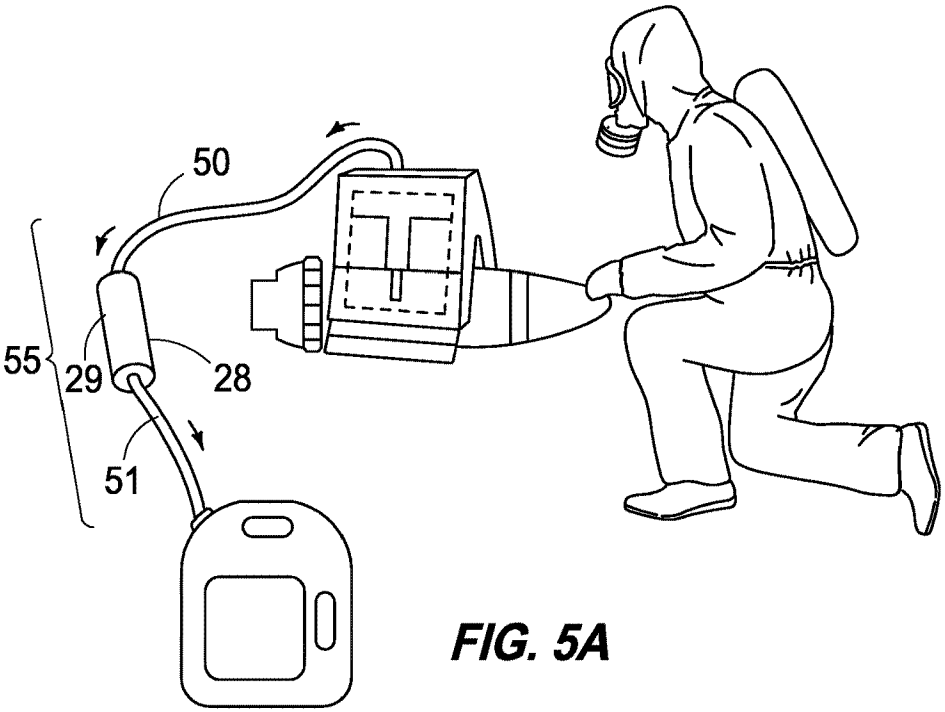

In accordance with example implementations and with reference to FIGS. 5A and 5B, a single cartridge filled with metal oxide particles can be connected to an access device. One or more cartridges can be connected in series or in parallel via a manifold and can be utilized to rapidly destroy items as small as a single munition or as large as a bulk storage container.

Example compositions and/or methods of the present disclosure can be configured, and to perform, as indicated in Table 1 below.

TABLE 1

Doped metal oxide detoxification with 90% GB.

| Sample # | % Volume $KF\text{-}Al_2O_3$ | % Volume $H_2O$ | % GB remaining (24 hours) NMR/GC | % GB remaining (48 hours) GC | % GB remaining (72 hours) GC |
|---|---|---|---|---|---|
| 1 | 0 | 0 | 84% | 75% | 65% |
| 2 | 2.06 | 0% | 64/46% | 10% | 4% |
| 3 | 2.06 | 4.5% | 21/15% | 3% | 1% |
| 4 | 2.06 | 5.45% | 16/11% | 3% | 1% |
| 5 | 2.06 | 7.27% | 15/10% | 1% | 0% |
| 6 | 2.06 | 9.1% | 3/2% | 0% | 0% |

The metal oxide catalysis technology will be adapted to a flow-through cartridge-based format to expand its destruction capabilities. The cartridge will be packed with doped metal oxides and through the use of an external pump or positive pressure displacement, agent will be pumped through the metal oxide cartridge. The cartridges can be hooked up to a fluidic pump source. External pumping approach is to invert the stoichiometry of the reaction; by pumping limited volumes of agent liquid through the external cartridge(s), the stoichiometric ratio of metal oxide particles to agent within the cartridge will vastly exceed 9:1 (v/v), thereby speeding up the reaction. This modular cartridge-based system wherein one or more metal oxide containing cartridges can be connected in series or in parallel via a manifold can be utilized to rapidly destroy agent volumes of varying size. Cartridge-based methods for catalytic reactions have demonstrated increased efficiency and catalytic rate over their bulk dispersion counterparts in terms of the conversion rate per catalyst weight. In addition, there are significant logistical gains in the transportation, operation, scaling, and waste disposal of such a modular design.

Figure 6:
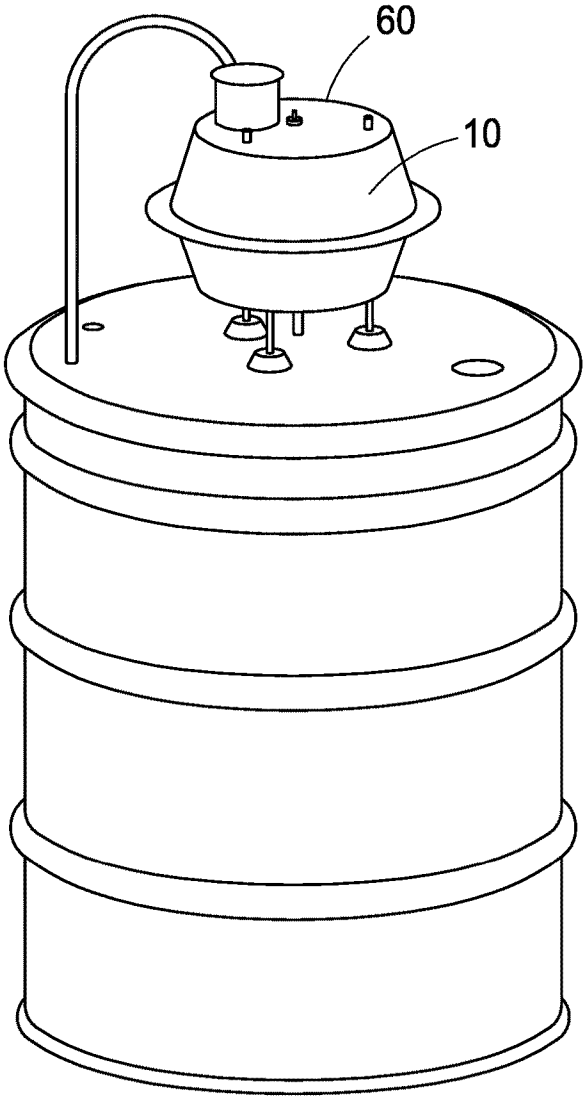
FIG. 6 depicts another method for detoxifying a chemical warfare agent according to embodiments of the disclosure.

Additionally, with reference to FIG. 6, an internally-recirculating destruction device is shown comprising metal oxide composition 10 and an internal recirculation pump 60. The advantage of this approach can be that composition 10, can be utilized as a drop-in to single containers and left to operate in either non-permissive environments, or where the ability to bring in resources to destroy an agent stockpile may be very limited. Here, the powder is delivered to a storage container at an approximately 1:10 (v/v) ratio of catalyst to agent. This approach has been demonstrated to work on G & V-series nerve agent simulants as well as half-mustards. In addition, live-agent destruction of CWAs GB and VX has been demonstrated in approximately 48 hours with minimal addition of water or stirring using this approach. The primary technical objective for this approach will be catalyst scaling, to optimize performance of the $KF/Al_2O_3$ catalysts and to scale production, as well as to build a chemically compatible recirculation device.

Figure 7:
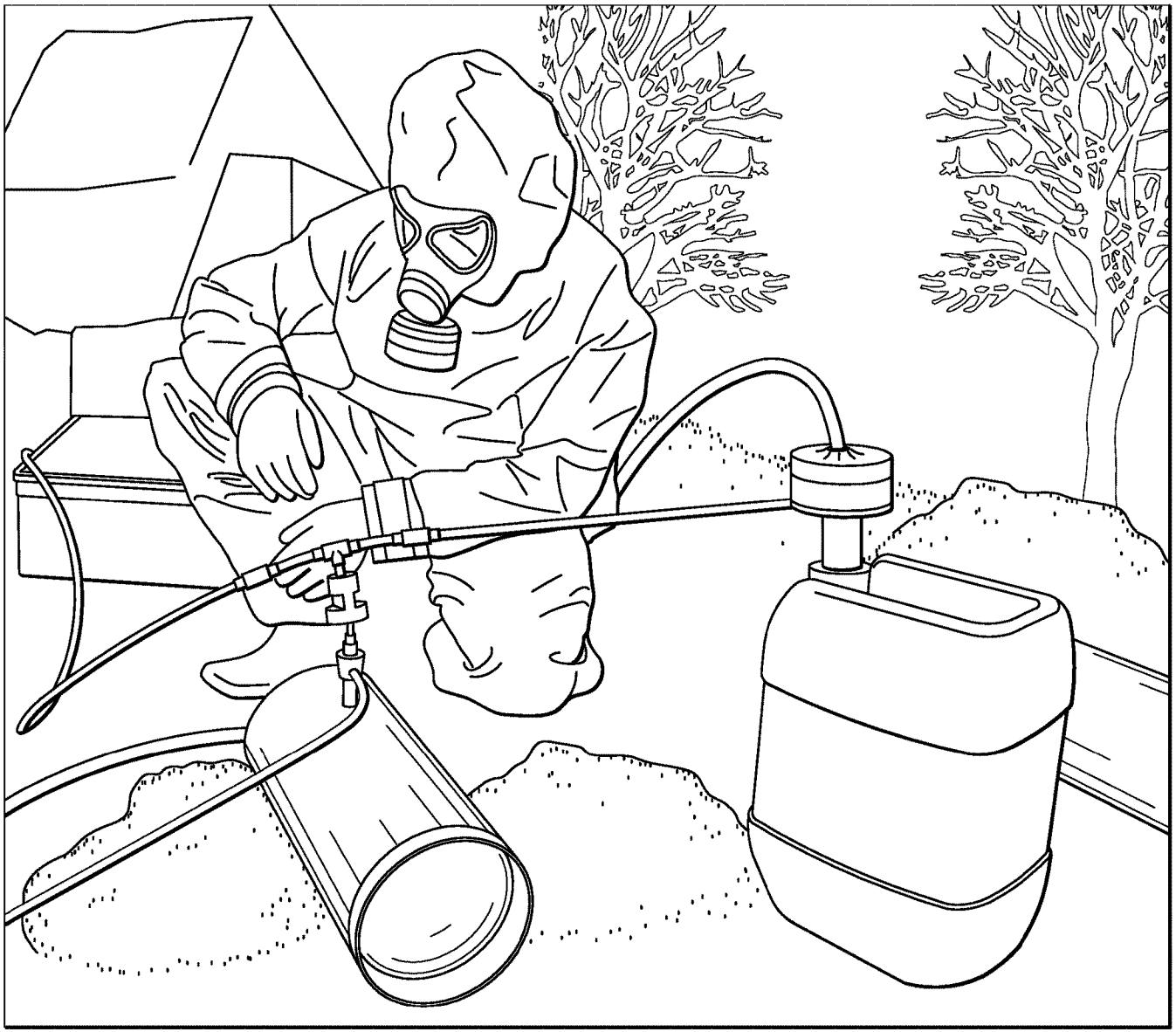
FIG. 7 depicts yet another method for detoxifying a chemical warfare agent according to embodiments of the disclosure.

The compositions and methods can also include an access device and fluidics delivery system which will be required for operation of both the dispersive and modular cartridge approaches as shown in FIG. 7 which can be consistent with a Material Agent Transfer System (MATS).

Compositions and methods of the present disclosure can also be used to detoxify WMDs within 12 hours. Using external catalysts in flowing systems as shown in FIG. 5B, a single cartridge will be able to destroy a small container such as a munition, while a suite of cartridges—either in series or in parallel—will be able to destroy larger quantities of agent, at least 1 metric ton. The rationale for the external pumping approach is to invert the stoichiometry of the reaction; by pumping limited volumes of CWA liquid through the external cartridges, the ratio of metal oxide particles to CWA will vastly exceed 9:1 (v/v). It is anticipated that the kinetics of destruction will be significantly more rapid, and that this solution will be the ultimate scalable approach to destroying munition threat caches, as well as substantially larger storage containers. The challenge for this approach will be optimizing the packing of the columns to permit rapid flow-through of chemical agents and maximum reactive surface area of the metal oxides. Flow-through catalytic reactors are commonly employed in the drug and chemical manufacturing industries, so the technical challenges presented are readily addressable with chemical engineering solutions.

The compositions and methods of the present disclosure were thoroughly tested against nerve-agent simulants in-house. Diethyl VX (DEVX, V-series) and Diisopropylfluorophosphate (DFP, G-series) have been utilized as simulants for nerve agents. Bulk reactors containing 90 wt % simulant and 10 wt % $KF/Al_2O_3$ were incubated at ambient temperatures. After various time points, aliquots were removed, extracted and analyzed via GC-MS to determine the amount of simulant that was destroyed by metal oxide nanoparticles. Several reaction conditions were tested: 1. Stagnant (no mixing) and no supplemental water; 2. Stagnant and 5% supplemental water added; 3. Mixing and no supplemental water; and 4. Mixing and 5% supplemental water added. In condition 2 and 4, where 5% supplemental water was added, the amount of $KF/Al_2O_3$ was reduced to 5 wt %, the additive total remained at 10%, with bulk simulant at 90 wt %.

Figure 8:
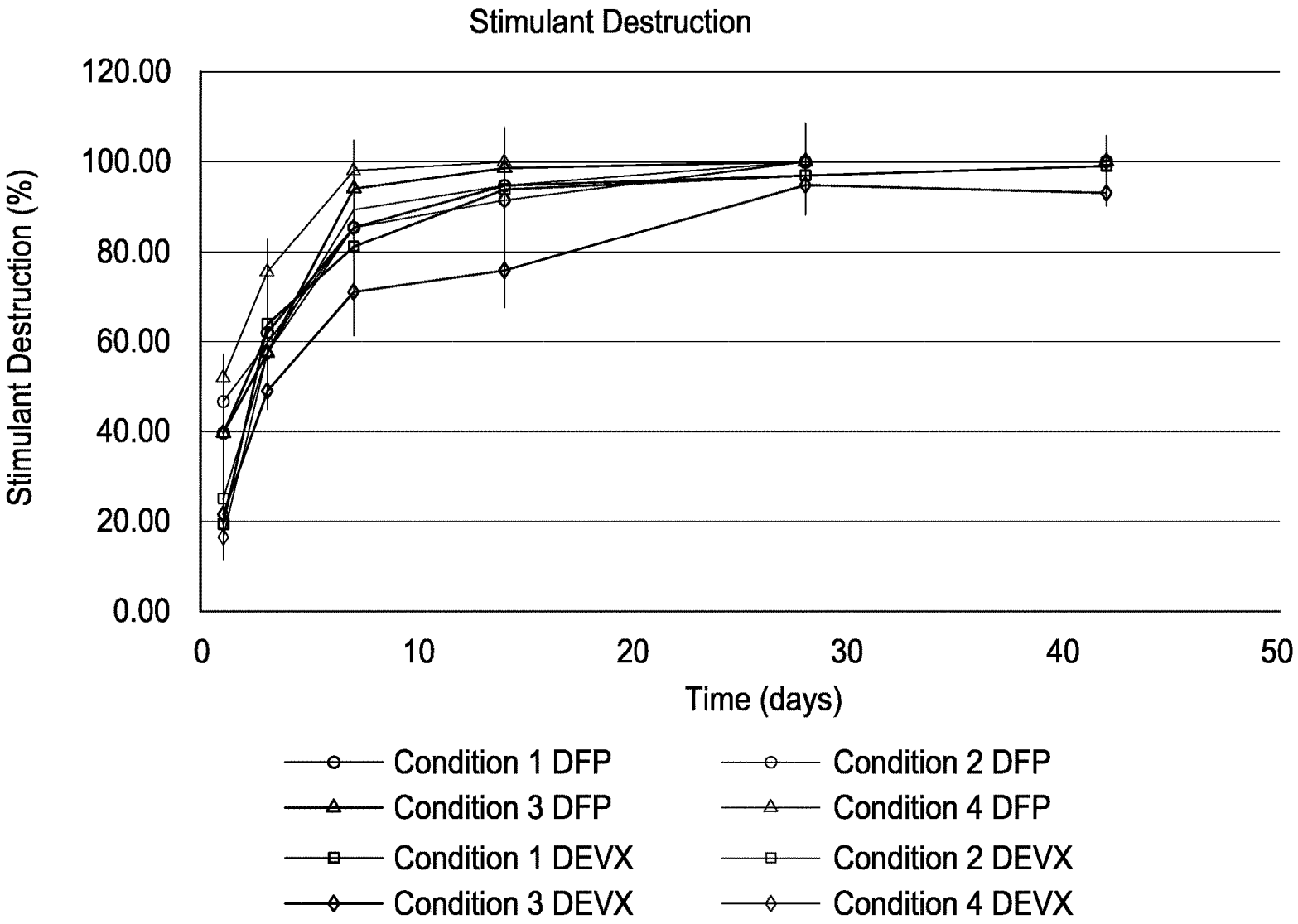
FIG. 8 is a graphical depiction of data representing stimulant destruction.

With continued incubation time, the rates of DFP destruction increase as shown in FIG. 8. DFP is completely destroyed by 2 weeks with or without supplemental water added. DEVX destruction is complete by 4 weeks. Rates of destruction could be further increased: with faster and more efficient mixing; greater addition of supplemental water, increased amount of metal oxides; or the addition of supplemental base.

Figure 9A:
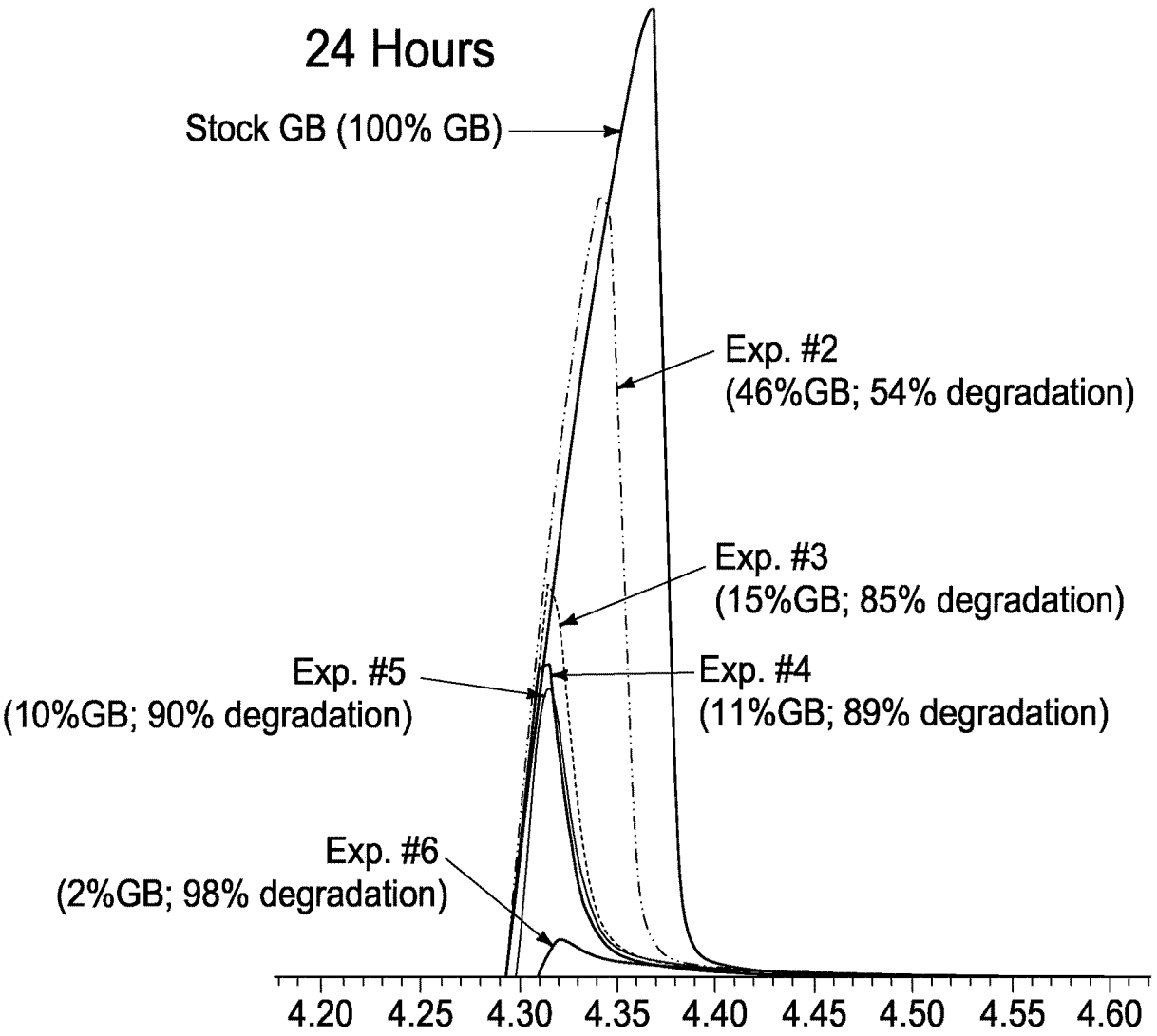
FIGS. 9A-9B are graphical depictions of data representing stimulant destruction at 24 hours and 48 hours, respectively.
Figure 9B:
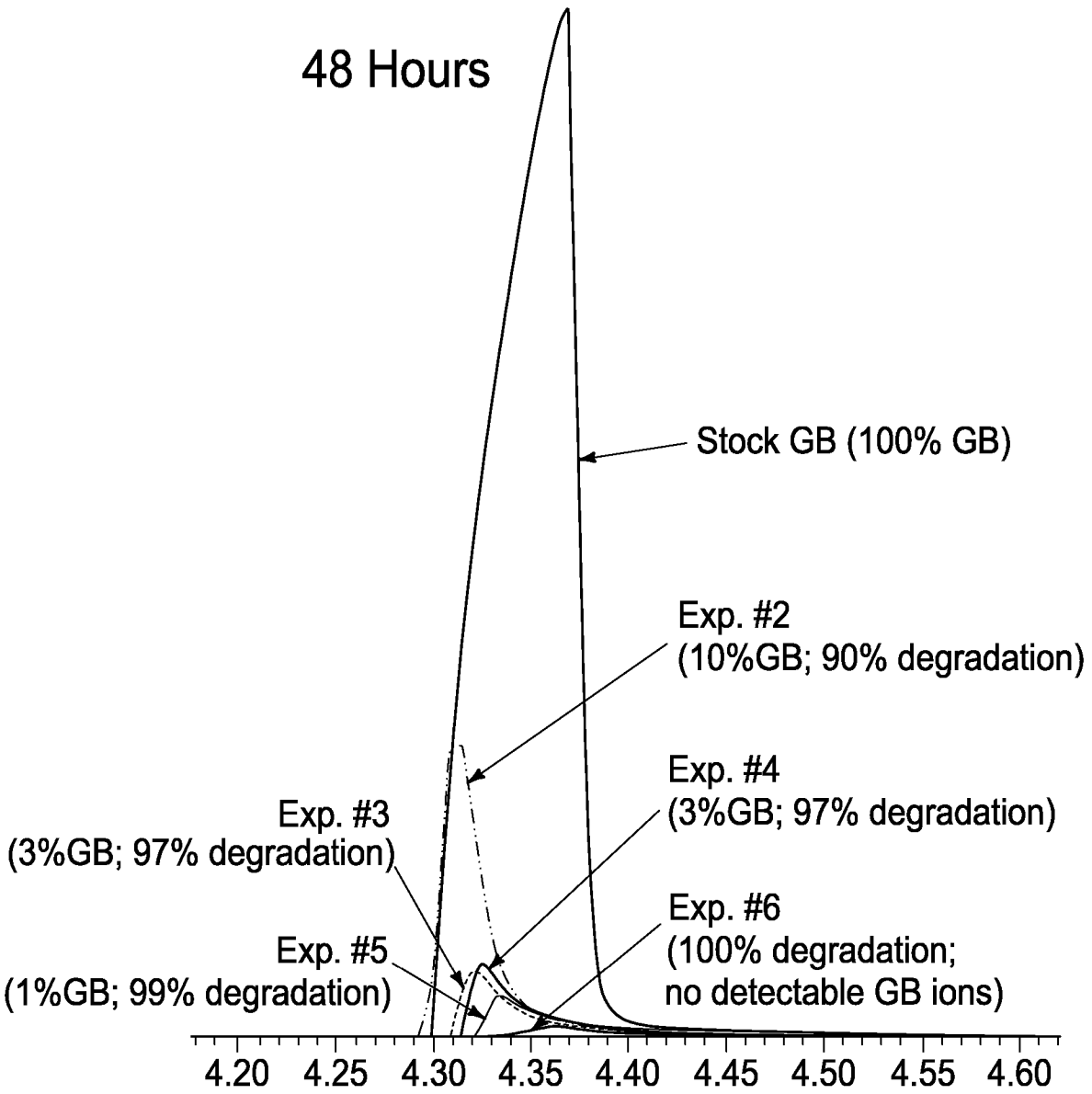

The compositions and methods were live-agent tested with sarin (GB) at and the data shown in FIGS. 9A-9B. Sample 2 corresponds to a scenario wherein only the metal oxide kit is added to agent with no supplemental water for agent destruction. In this case, 96% of the bulk GB was destroyed in 72 hours. Sample 5 corresponds to addition of the metal oxides with water supplementation up to 10% of the total volume. In this sample, 100% of the GB was destroyed after 72 hours. Additional water increases the rate of GB destruction; by varying the amount of water added, the rate of agent destruction can be increased and tailored to meet various mission needs.

Figure 10A:
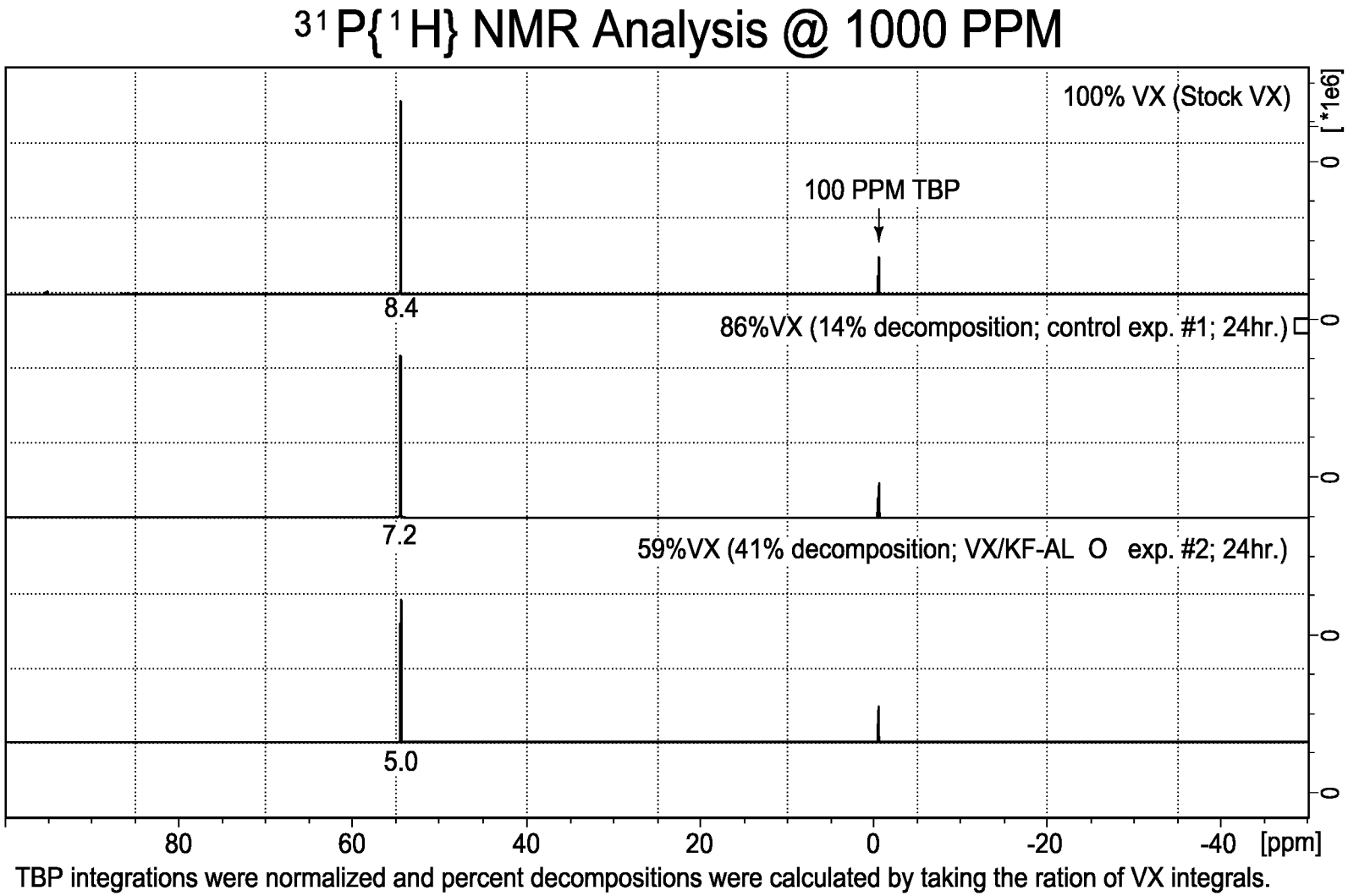
FIG. 10A is NMR data representing stimulant destruction at different time intervals.
Figure 10B:
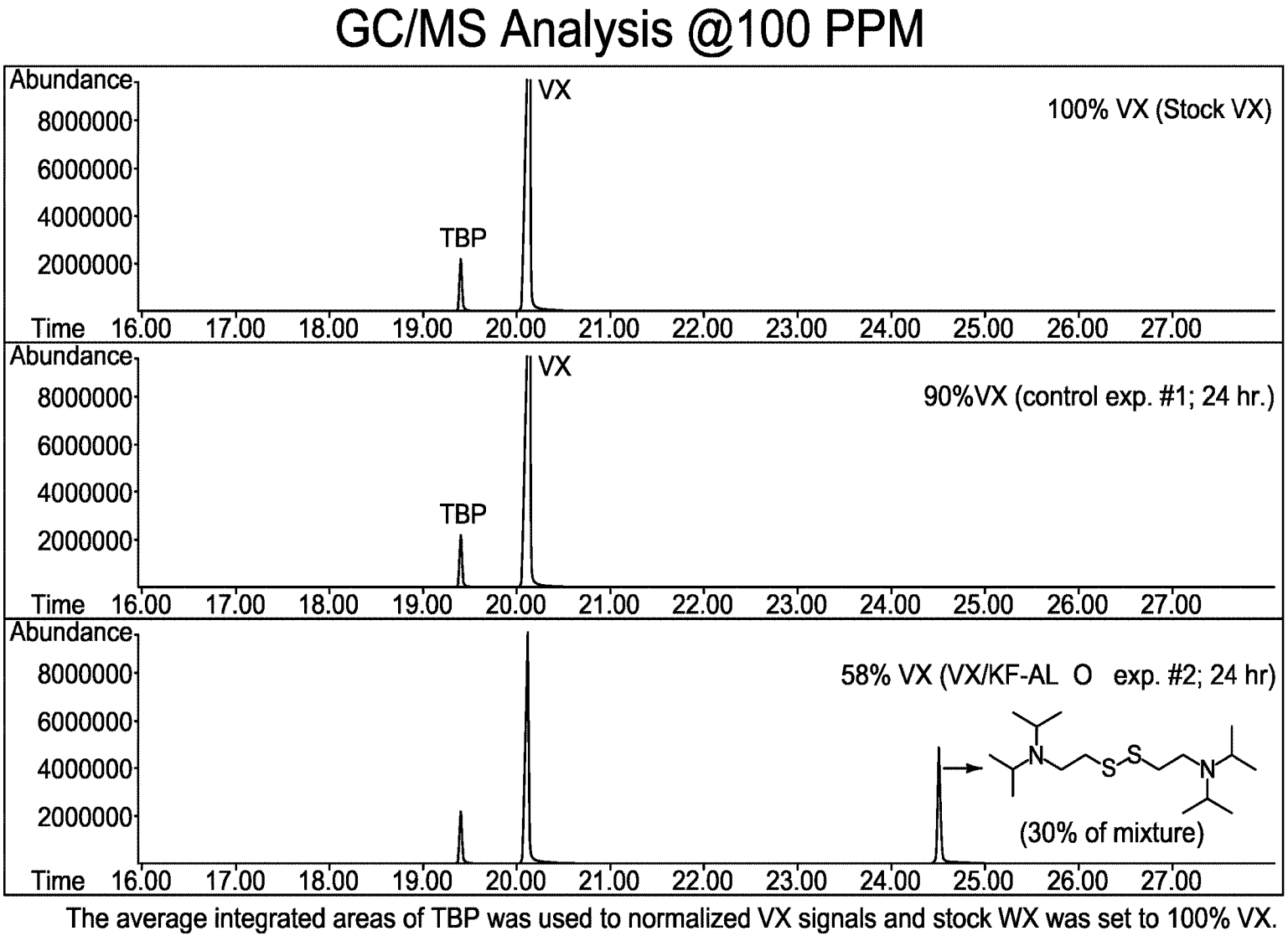
FIG. 10B is GC/MS data representing stimulant destruction at different time intervals.

The compositions and methods were also tested for potential to destroy bulk VX agent. The compositions were exposed to VX at a 90:10 (v/v) agent: additive ratio. After 24 hours, 40% of the VX was detoxified (versus only 10% control with water added). FIGS. 6A and 10B show both the $^{31}P$ NMR and GC-MS data. Additional testing is required to evaluate performance at longer time periods. Further timepoints were not evaluated. Additional testing to evaluate the performance of the system when hydrolysis is supplemented with water is also required; it is likely that water supplementation could improve the rate of VX destruction.

The potential enthalpy of mixing, and potential heat/pressure buildup by adding water and $KF/Al_2O_3$ to bulk dimethyl methyl phosphonate (DMMP, a G-series simulant) was also evaluated. Additives ($KF/Al_2O_3$ and water) were combined at 10 wt % to 90 wt % DMMP in a 5-gallon mock barrel. The addition of bulk water caused an immediate 6° C. temperature increase which gradually reduced within ten minutes. The bulk heat capacity of the liquid dissipates the enthalpy of mixing sufficiently that it is not a concern; addition of doped metal oxides with supplemental water or base cause no potential issues of increasing heat or pressure to a bulk-agent container.

Figure 11:
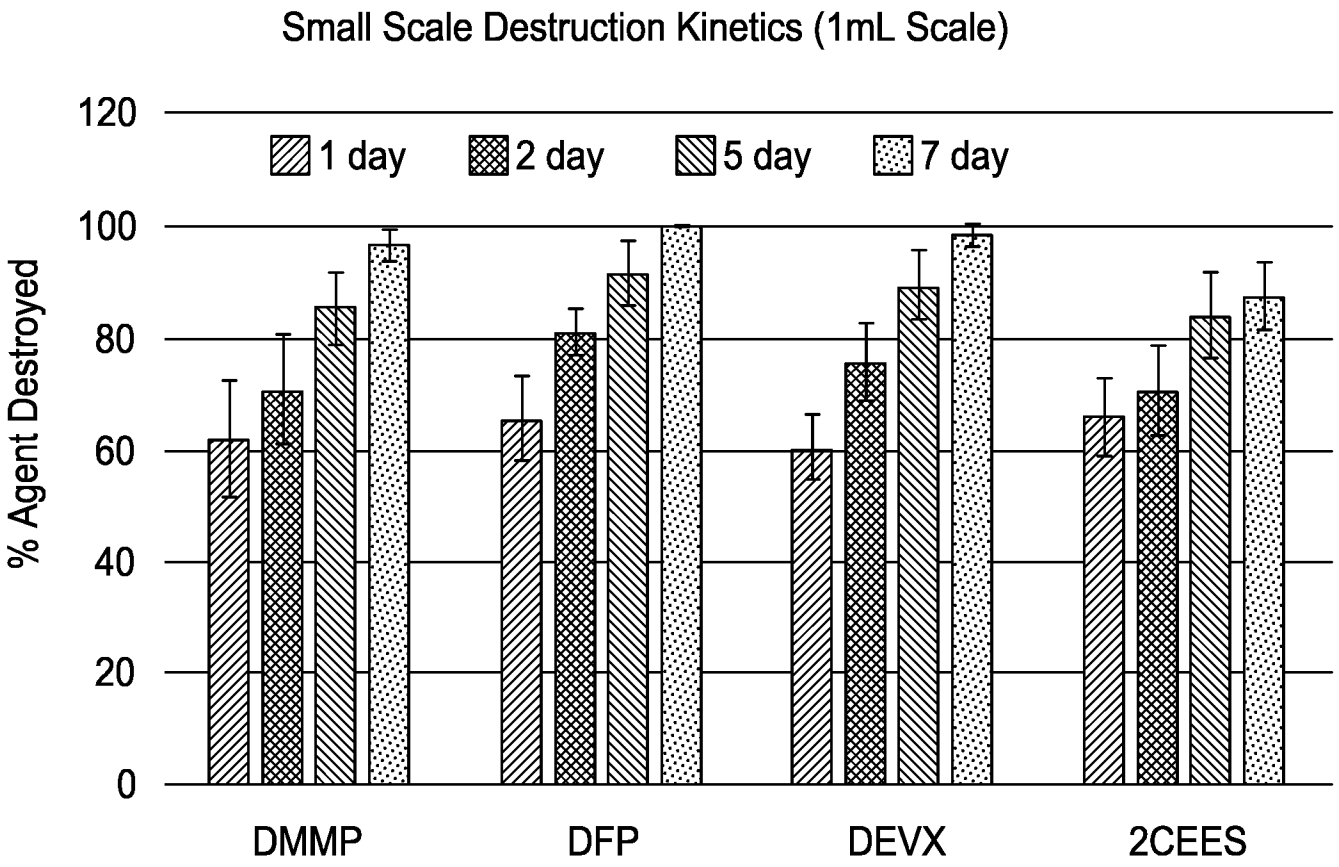
FIG. 11 is a graphical depiction of data representing small scale stimulant destruction.

The destruction of bulk G- & V-series nerve agent simulants DFP and DEVX can be optimized, and the efficacy with the HD mustard simulant 2-chloroethyl ethyl sulfide (2-CEES), half-mustard demonstrated. FIG. 11 illustrates the kinetics of destruction of these simulants alongside the bulk simulant DMMP at the 1-mL scale. After 7 days, DMMP, DFP, and DEVX were completely destroyed, while 2-CEES was 90% destroyed, the extent of destruction increased with longer time points. Faster destruction kinetics were seen at the 1-mL scale when compared to previous sub-mL scale (FIG. 8), due to more efficient reactor mixing, which enables greater interaction between the simulant and the catalyst.

Figure 12:
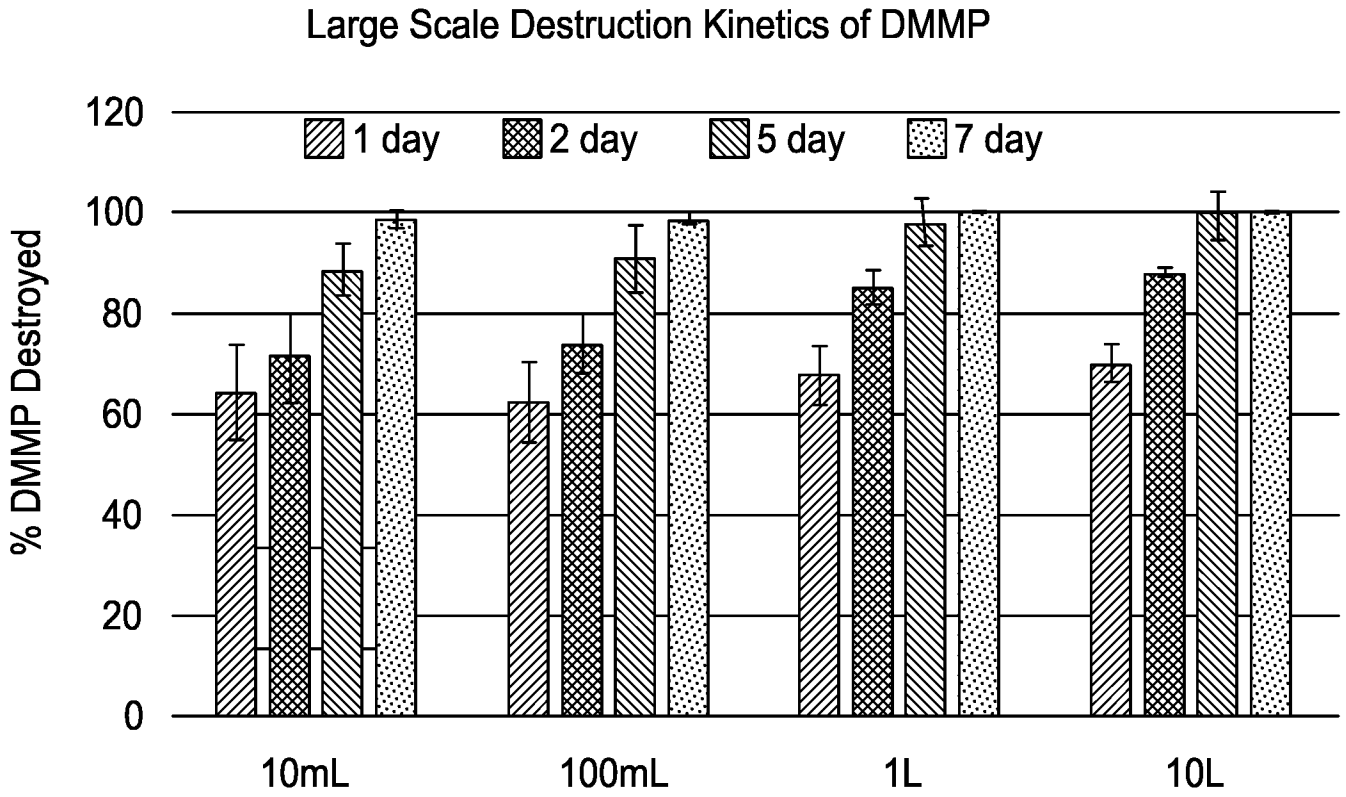
FIG. 12 is a graphical depiction of data representing large scale stimulant destruction.

Additionally, scaling of the destruction kinetics with simulant volume has been demonstrated at the 10-mL, 100-mL, 1-L and 10-L scale with DMMP (FIG. 12), to ensure that the agent destruction kinetics will be as good or better as the chemistry is scaled up and applied to larger-volume containers. Complete destruction of DMMP was observed at all scales between days 5 and 7. The data illustrate that the small-scale DMMP data have good correlation with the large-scale data up to 10 L; the destruction kinetics are essentially the same as the formulation is scaled. The strong correlation between simulant and agent will be evaluated as the effort kicks off. The optimized formulation will be tested with GD, VX, and HD and the measured kinetics will be compared to the kinetics observed for the simulants to estimate the quantity of $KF/Al_2O_3$ and the time required to achieve destruction of larger quantities of agents.

In accordance with example implementations, bulk reactors containing 90 wt % CWA (simulant) and 10 wt % $KF/Al_2O_3$ and allowed to react at ambient temperatures. The data of FIGS. 10-12 were generated by sampling after various time points, aliquots were removed, extracted and analyzed via GC-MS to determine the amount of simulant that was destroyed by metal oxide nanoparticles. Initial reactions were performed using DEVX, DFP and DMMP at the 100 μL scale. Metal oxides (10 wt %) were added to 90 wt % DFP, DMMP and DEVX and allowed to incubate at ambient temperatures for up to 4 weeks. DFP and DMMP were completely destroyed between 1 and 2 weeks; DEVX was completely destroyed between 2 and 4 weeks.

To improve destruction kinetics, the reactions were scaled to 1 mL, and active mixing (via a magnetic stir-bar and stir plate) was added. Bulk reactors containing 90 wt % DFP, DMMP or DEVX and 10 wt % $KF/Al_2O_3$ were incubated at ambient temperatures in 1 mL glass vials and kept stirring at 250 rpm for the duration of the experiments. To date we have demonstrated that after a 24-hour incubation approximately 63% of each simulant is destroyed; after 48-hours approximately 75% of each simulant is destroyed, and after 1-week almost all simulant is destroyed by the doped metal oxide compositions.

To ensure the destruction kinetics scaled to larger volumes, DMMP was utilized to scale from 1 mL to 10 L. At all scales simulant: additive ratio was 90:10. Reactions volumes: scale from 1 mL, 10 mL, 100 mL, 1 L and 10 L. In all cases the rate of destruction remained the same or increased with larger volumes of DMMP. To date we have demonstrated that 66% of DMMP is destroyed after 24 hours, 79% of DMMP is destroyed after 48 hours and after 1 week>99% simulant is destroyed by the doped metal oxide compositions.

The compositions and methods of the present disclosure were live-agent tested with sarin (GB) organophosphorus nerve agent to identify chemical weapons in samples. When the metal oxide was added to GB at a 90:10 (v/v) agent: metal oxide ratio, 96% GB was destroyed in 72 hours. Through the addition of supplemental water (up to 10%) the destruction kinetics of GB increased, and 100% destruction was achieved by 72 hours.

The compositions and methods of the present disclosure were also tested for potential to destroy bulk VX agent. The metal oxide composition was added to VX at a 90:10 (v/v) agent: additive ratio. After 24 hours, 40% of the VX was detoxified (versus only 10% control with water added).

Figure 13:
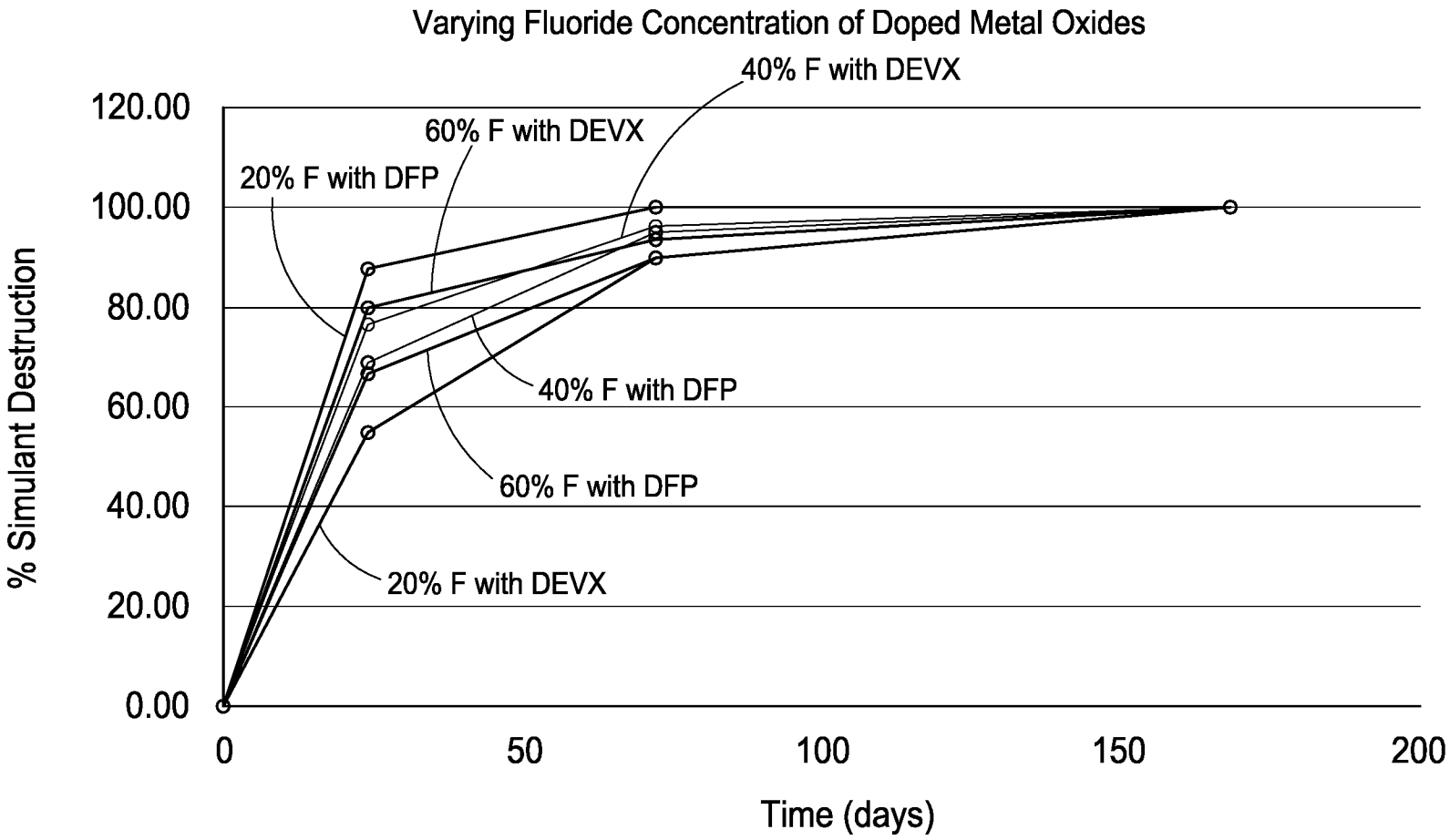
FIG. 13 is a graphical depiction of data representing varying amounts of Fluoride within the composition.

The concentration of the fluoride of the composition metal oxide can be varied from 20% to 80% by weight. Varying the amount of fluoride may affect the kinetic rate of agent destruction and is specific to both the agent type and dope composition. As shown in FIG. 13. metal oxides doped with lower concentrations of fluoride result in faster rates of destruction for the G-series simulant DFP, while higher concentrations of fluoride result in faster rates of destruction for the V-series simulant DEVX. This effect is most prominent in initial rate of decomposition since at longer incubation periods both G-series and V-series nerve agent simulants are completely destroyed by the doped metal oxides regardless of their fluoride concentration. With reference to FIG. 13, metal oxides were supplemented with varying amounts of fluoride and tested for their rates of destruction against both G-series and V-series nerve agent simulants, DFP and DEVX respectively. Lower concentrations of fluoride resulted in a faster rate of destruction against DFP, while higher concentrations of fluoride resulted in a faster rate of destruction against DEVX. With longer incubation times, complete agent destruction is seen independent of fluoride concentration.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A doped metal oxide composition consisting of:
fluoride;
alumina; and
less than 10% $H_2O$.

2. The doped metal oxide composition of claim 1 wherein the fluoride is present from between 20 and 80% by weight of the composition.

3. The doped metal oxide composition of claim 1 wherein the fluoride is selected from potassium fluoride.

4. The doped metal oxide composition of claim 1 wherein the alumina is selected from aluminum oxide.

5. The doped metal oxide composition of claim 1 wherein the composition is in the form of nanoparticles.

6. A detoxification reaction comprising a mixture of less than 50% by weight of the doped metal oxide composition of claim 1 and a chemical warfare agent.

7. The detoxification reaction of claim 6 wherein the fluoride is selected from one or more of tetra-n-butylammonium fluoride; potassium fluoride; silver fluoride; and/or sodium fluoride.

8. The detoxification reaction of claim 6 wherein the alumina is selected from aluminum oxide.

9. The detoxification reaction of claim 6 wherein the chemical warfare agent comprises organophosphate nerve agents, G series nerve agents, V series nerve agents, mustard agents, and/or HD sulfur mustard agents.

10. A cartridge comprising a doped metal oxide composition, the composition consisting of fluoride, alumina, and less than 10% $H_2O$.

11. The cartridge of claim 10 further comprising a main housing and operable inlet and exit ports.

12. The cartridge of claim 11 wherein the cartridge is configured as a flow through cartridge.

13. The cartridge of claim 10 further comprising a main housing and an operable releasable seal.

14. The cartridge of claim 13 wherein the operable releasable seal is configured as a cap that can be removed to allow for the discharge of the doped metal oxide composition.

15. The cartridge of claim 13 wherein the releasable seal and/or the main housing is configured to decompose in the presence of a chemical warfare agent.

16. A method for detoxifying a chemical warfare agent, the method comprising exposing the chemical warfare agent to the doped metal oxide composition of claim 1, wherein the doped metal oxide composition is less than 50% by mass of the chemical warfare agent.

17. The method for detoxifying a chemical warfare agent of claim 16 wherein the exposing comprises adding the doped metal oxide composition to a vessel containing the chemical warfare agent.

18. The method for detoxifying a chemical warfare agent of claim 17 wherein adding the doped metal oxide composition comprises dispensing the doped metal oxide composition from a container into the vessel.

19. The method for detoxifying a chemical warfare agent of claim 17 wherein adding the doped metal oxide composition comprises depositing a container housing the doped metal oxide composition into the vessel.

20. The method for detoxifying a chemical warfare agent of claim 16 wherein the exposing comprises providing the chemical warfare agent through at least one housing containing the doped metal oxide composition.

21. The method for detoxifying a chemical warfare agent of claim 20 wherein the providing the chemical warfare agent comprises flowing the chemical warfare agent through the at least one housing containing the doped metal oxide composition.

22. The method for detoxifying a chemical warfare agent of claim 20 wherein the mass of chemical warfare agent provided through the at least one housing is greater than 50% of the mass of the doped metal oxide composition within the at least one housing.

23. The method for detoxifying a chemical warfare agent of claim 20 further comprising providing a second housing containing the doped metal oxide composition.

24. The method for detoxifying a chemical warfare agent of claim 23 wherein the exposing comprises providing the chemical warfare agent through the at least one housing and the second housing.

25. The method for detoxifying a chemical warfare agent of claim 23 wherein the providing the chemical warfare agent comprises flowing the chemical warfare agent through the at least one housing and the second housing.

26. The method for detoxifying a chemical warfare agent of claim 23 wherein the mass of chemical warfare agent provided through the at least one housing and the second housing is greater than 50% of the mass of the doped metal oxide composition within the at least one housing and the second housing.

27. The method for detoxifying a chemical warfare agent of claim 23 wherein the at least one housing and the second housing are aligned in series.

28. The method for detoxifying a chemical warfare agent of claim 23 wherein the at least one housing and the second housing are aligned in parallel.

* * * * *